US008443774B2

(12) United States Patent
Plasencia Marichal

(10) Patent No.: US 8,443,774 B2
(45) **Date of Patent: *May 21, 2013**

(54) CAMSHAFT VARIATOR DEVICE

(76) Inventor: Pedro A. Plasencia Marichal, S/C de Tenerife (ES)

( * ) Notice: Subject to any disclaimer, the term of this patent is extended or adjusted under 35 U.S.C. 154(b) by 265 days.

This patent is subject to a terminal disclaimer.

(21) Appl. No.: 12/085,206

(22) PCT Filed: Nov. 16, 2005

(86) PCT No.: PCT/ES2005/000625
§ 371 (c)(1),
(2), (4) Date: Mar. 7, 2009

(87) PCT Pub. No.: WO2007/057479
PCT Pub. Date: May 24, 2007

(65) Prior Publication Data

US 2009/0223471 A1 Sep. 10, 2009

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.18, 90.17; 464/1, 464/2, 160
See application file for complete search history.

(56) References Cited

U.S. PATENT DOCUMENTS

| | | | | |
|---|---|---|---|---|
| 4,976,229 | A | 12/1990 | Charles | |
| 5,326,321 | A | 7/1994 | Chang | |
| 5,381,764 | A | 1/1995 | Fukuma et al. | |
| 5,592,909 | A | 1/1997 | Tsuruta | |
| 5,803,030 | A | 9/1998 | Cole | |
| 5,860,328 | A | 1/1999 | Regueiro | |
| 6,167,854 | B1 | 1/2001 | Regueiro | |
| 6,199,522 | B1 | 3/2001 | Regueiro | |
| 6,352,060 | B1 | 3/2002 | Bentley | |
| 6,640,760 | B1 * | 11/2003 | Plasencia | 123/90.17 |

FOREIGN PATENT DOCUMENTS

GB 0347806 A 5/1931

* cited by examiner

*Primary Examiner* — Ching Chang
(74) *Attorney, Agent, or Firm* — Walker, McKenzie & Walker, P.C.

(57) ABSTRACT

The invention relates to a camshaft variator device for an internal combustion engine which includes a crankshaft and a camshaft. The invention includes: a first component which is rigidly connected to the camshaft of the engine, such that the rotation of the first component causes the camshaft to rotate; a second component which is rotated by the crankshaft of the engine; a third component which connects the first and second components to one another and which, in turn, rotates the first component in relation to the second component in order to vary the position and partial speed of the camshaft in respect of the crankshaft; and a fourth component which is used to impart a longitudinal and reciprocating longitudinal movement to the third component. The purpose of the device is to enable the opening and closing time and duration of the valves to be varied by varying the position and partial speed of the camshaft in relation to the crankshaft.

13 Claims, 8 Drawing Sheets

CAMSHAFT VARIATOR DEVICE

BACKGROUND OF THE INVENTION

The present invention relates to internal combustion engines, and, more specifically, it is a device to vary the position and angular speed of a camshaft of an internal combustion engine.

A classical internal combustion engine includes an engine block, a plurality of reciprocating pistons that move alternatively inside the cylinders, a crankshaft coupled to the pistons in order to be rotated by the alternating movement of said pistons and a camshaft moved by the crankshaft through either a chain drive or belt drive. As the camshaft rotates, the cam lobe profile, fixed to the camshaft by cam lobes, pushes the intake valves or exhaust valves, causing the valves to open. After the cam lobe profile ceases to operate, it allows springs to return the valves to closed position. The design of the cam lobes and the position determines, among other things, the length of time the valves are held open.

In a standard four stroke engine, a cycle of operation (intake, compression, power and exhaust) takes place over four strokes of the piston, made in two crankshaft revolutions. When a piston is at the top of the cylinder at the beginning of the intake stroke, the intake valve opens and the descending piston draws in the air-fuel mixture. At the bottom of the stroke, the intake valve closes and the piston starts upward on the compression stroke. Just before or as the piston reaches the top again, the compressed air-fuel mixture is ignited by the firing of a spark plug, forcing the piston down on its power stroke. As the piston reaches the bottom of its stroke, the exhaust valve opens, allowing combustion products to be forced out through the exhaust valve.

Some internal combustion engines use dual camshaft, one to operate the intake valves (admission) and the other to operate the exhaust valves. Both camshafts in a dual camshaft engine can be driven by a chain drive or belt drive.

The performance of an internal combustion engine can be improved by changing the positional relationship of the camshaft relative to the crankshaft. For example, the camshaft can be retarded or delayed closing the intakes valves. In a dual camshaft engine, retarding or advancing the camshaft can be accomplished by changing the positional relationship of one of the camshaft, usually the camshaft that operates the intakes valves of the engine, relative to the other camshaft and the crankshaft. Retarding or advancing the camshaft varies the timing of the engine in terms of the operation of the intake valves relative to the exhaust valves, or in terms of the operation of the valves relative to the position of the crankshaft. This is achieved by the device, which is my property, the U.S. Pat. No. 6,640,760.

On the other hand the performance of an internal combustion engine can be improved if the intake valve is able to stay open longer during the intake stroke, to allow a greater quantity of air-fuel mixture to enter. Therefore the performance of an internal combustion engine can be improved in both ways:

1. Changing the position of the camshaft in relation to the crankshaft or changing the normal position of the intake camshaft in relation to the exhaust camshaft and the crankshaft (function already achieved in the U.S. Pat. No. 6,640,760) and
2. keeping the intake valve opened longer to allow a greater quantity of air-fuel mixture to enter in to the piston.

DETAILED DESCRIPTION OF THE INVENTION

The camshaft variator device 11 is designed to be used with a classic internal combustion engine, like that of a car for example.

The internal combustion engine includes a crankshaft 13 and a camshaft 15 having a longitudinal axis 17.

The camshaft variator device 11 includes a first component 19, preferably in alignment with the longitudinal axis 17 of the camshaft 15, to be joined with the camshaft 15, furthermore the rotation of the device 11 cause the rotation of the camshaft 15; a second component 21 preferably in alignment with the longitudinal axis 17 of the camshaft 15, to be rotated by the crankshaft 13; and a third component 23, preferably in alignment with the longitudinal axis 17 of the camshaft 15 for joining the first and second component 19 and 21 to one another so that the first component 19 will rotate when the second component 21 is rotated by the crankshaft 13 and for rotating the first component 19 relative to the second component 21 for the purpose of rearranging the positional relationship of the camshaft 15 relative to the crankshaft 13.

The camshaft variator device 11 is preferably designed such that the longitudinal movement of the third component 23 relative to the first component 19 causes the rotation of the first component 19 in relation to the second component 21, and preferably includes a fourth component 25 for causing longitudinal movement of the third component 23. The fourth component 25 includes a motive power component like an electric motor 100, 101, said electric motor rotates the fourth component 25 via the coaction between the gear of the electric motor and the fourth component 25 gears to produce a longitudinal movement and alternative longitudinal movement of the third component 23. The first component 19 includes preferably a transmission mechanism 29 of the first component 19, it has one or more (preferably three) spiral teeth 31 and a third component 23 that includes preferably a transmission mechanism 33 that it has one or more (at least three) spiral teeth 35 to act with the spiral teeth 31 from the transmission mechanism 29 of the first component 19, therefore the longitudinal movement of the transmission mechanism 33 of the third component 23 relative to the transmission mechanism 29 of the first component 19 will cause the rotation of the transmission mechanism 29 of the first component 19. The transmission mechanism 29 of the first component 19 could be machined or constructed like a shaft with spiral teeth made of carbon steel or similar. The transmission mechanism 33 of the third component 23 could be machined and constructed in carbon steel, like a ring with spiral teeth.

The second component 21 preferably includes a wheel 37 with an external pulley with teeth to fit with a chain drive or belt drive 39, said pulley is moved for another pulley with gear teeth 40, joined in the crankshaft 13 (See FIG. 4). This way, the gear 37 has external teeth to use with a chain drive or external grooves to use with a belt drive.

The second component 21 includes preferably a body or a ring joined to a gear drive. The ring 41 could be machined in carbon steel or made of plastic like nylon or similar.

The third component 23 is preferably secured to the second component 21 in a manner which prevents rotation of the transmission mechanism 33 of the third component 23 in relation to the second component 21, and which allows longitudinal movement of the transmission mechanism 33 of the third component 23 in relation to the second component 21. For example, the third component 23 includes a plurality of spaced apart male members or guides 43, and the second component 21 should have a plurality of spaced apart female members or apertures 45 in the ring 41 for slidably receiving the guides 43 of the third component 23 to secure the second and third component 21, 23 together in a manner which allows longitudinal movement of the third component 23 relative to the second component 21 while restricting or preventing rotation of the component 23 in relation to the second component 21. The guides or rods 43 may be machined or manufactured of carbon steel and could be hollow to reduce weight (See FIG. 9A).

The bushings 47 may be machined or otherwise manufactured out of bronze or the like.

The third component 23 preferably includes a sliding brick 49 for joining the transmission mechanism 33 of the third component 23 to the guides 43. For example, the sliding brick 49 may have holes 51 therein for receiving the ends of the guides 43 which are attached by screws in a central opening 53 to receive the transmission mechanism 33 of the third component 23.

The sliding brick 49 may be machined or constructed of carbon steel or similar. The camshaft variator device 11 preferably includes a first thrust bearing 55 located between the first component 19 and the second component 21 for allowing unrestricted rotation between the first component 19 and the second component 21, and in the other hand a second thrust bearing 57 positioned between the third component 23 and the fourth component 25 for allowing unrestricted rotation between third component 23 and the fourth component 25.

The third component 23 preferably includes an edge 59, 61 that belongs to the sliding brick 49, both edges 59 and 61 allow the longitudinal movement of the fourth component 25 with the third component 23 and at the same time allow the rotation of the fourth component 25 in relation to the third component 23.

The third component 23 preferably includes a plurality of screws 63 along the sliding brick 49 and a transmission mechanism 33 of the third component 23 to join these pieces together, in the other hand the transmission mechanism 33 of the third component 23 has a key edge 105 tongue and groove to fit in the sliding brick 49 to ensure no rotation between the transmission mechanism 33 of the third component 23 and the sliding brick 49.

The fourth component 25 preferably includes a first and second ring container 71, 65; both rings 71, 65 are joined to create a cavity to locate the thrust bearing 57 to prevent or restrain the longitudinal movement of the fourth component 25 in relation to the thrust bearing 57 and therefore to the third component 23. These two container pieces 71 and 65 may be made of nylon or similar material.

The first container ring 65 has on one face a plurality (at least two) profiles or reliefs of variable height in its length 65A to apply a longitudinal force (when the container ring 65 rotates) on a point in the plurality of profiles and reliefs 69A located on the ring 69.

The fourth component 25 should include a plurality of screws along the first container ring 65 and the second container ring 71 to keep said pieces together.

The second component 21 preferably includes a third and fourth container rings 75, 77, said rings are joined to center principal thrust bearing 55 in relation to the ring 41 and join the thrust bearing 55 to the second component 21 allowing the rotation of both pieces. The third and fourth container ring 75, 77 may be machined, made of plastic like nylon or the like.

The second component 21 should include a plurality of screws to join the first container ring 75, the second container ring 77 and the ring 41.

The transmission mechanism 29 of the first component 19 preferably is a shaft with an end 79 and the other end 81, both of which have spiral teeth 31.

The first component 19 preferably includes a first connection 83 joined to the end 79 of the transmission mechanism 29 of the first component 19 via tongue and groove 85 located in the end of the shaft 79; and a pair of screws 86 to join the first connection 83 via tongue and grove 85. The first component includes a first connector 83, which has a changed section of a diameter 89 that houses the head of a screw that connects to a third connector 95, and the second connector 93 with camshaft 15. The first connector 83 should be manufactured or constructed with carbon steel or the like.

The first component 19 includes second and third connectors 93 and 95 to locate the thrust bearing 55 to avoid the longitudinal movement of the second component 21 in relation to the first component 19 and to allow the rotation of the second component 21 in relation to the first component 19, thanks to the transmission mechanism 29 of the first component 19 and the transmission mechanism 33 of the third component 23.

The second and third connectors 93, 95 have a hole running through them so that they can be joined via a screw to the camshaft 15. The camshaft 15 will rotate when the crankshaft 13 will rotate the second component 21 thanks to the timing belt or chain 39 and the wheel member 37, causing the third component 23 to rotate via the coaction between the ring 41 and the guides 43, causing the first component 19 to rotate via the coaction between the first and third transmission mechanisms 29, 33 as shown in the drawings. Then the camshaft variator device can advance or retard the valve timing when different sensors in the engine send the respective signal to move the electric motor 100 and rotating the fourth component 25 at the same time to apply a longitudinal force over the third component 23 in order to rotate the first component 19 in relation to the second component 21 in the longitudinal axis 17 of the camshaft 15, thanks to the transmission mechanisms 29, 33 of the first component 19 and third component 23 and the interaction between the nylon ring 41 and the guides 43. Another design of the guides (See FIG. 9A) shows the same guide being hollow to be lighter.

The fourth component 25 includes many parts and its purpose is to apply a longitudinal force to the third component 23. It looks like the fourth component of the U.S. Pat. No. 6,640,760, but it is located in a different position and it has more parts. The earlier location was the end of the third component 23 and now it is located between the second component 21 and the third component 23 to achieve a more compact device and more accurate function.

The fourth component includes:

- A ring with a plurality of rods 69 (at least two rods) with round profiles or reliefs 69A located at the end of the rods and holes located in the end of the rods. These holes fit the rods 98.
- Another ring 65 includes on one side a plurality of profiles and reliefs of variable height 65A and on the other side a plurality of cavities, in these cavities are located a plurality of profiles and reliefs of variable height 67A and at the same time this piece includes: a plurality of gear teeth 65B located in the outer side, and a changed section located in the rear side to fit the thrust bearing 57.
- Another ring 67 includes a plurality of cavities located in one side of the ring, in these cavities are located a plurality of profiles and reliefs of variable height 73B, on the other side there is a plurality (at least four) of profiles and reliefs of variable height 67A, also includes gear teeth 67B located on the outer side.
- Another ring 73 includes a semi-circular cavity 73A located on one side where there is an eccentric cam 91 and in the opposite side has a plurality of profiles and reliefs of variable height 73B.
- Another ring 71 includes a changed section located on one side, which, joined with the back part of the ring 65 which includes a changed section located in the rear; a thrust bearing 57 is attached to the changed section of ring 71 and ring 65.

And two electric motors 100, 101 where the electric motor 100 via coaction with the gear teeth 102 move the straight teeth 65B of the ring 65 in both directions and the second electric motor 101 via coaction with the gear teeth 103 move the straight teeth 67B of the ring 67 in both directions.

The ring 41 has on its edges a plurality of gears 41A that are coupled and synchronized in movement with the plurality of gears 107, 108, and 106, that move the eccentric cams 91 and 91A.

A plurality of eccentric cams 91 and 91A joined with a gear 106 where said eccentric cams act on the semi-circular cavities 73A of the ring 73.

A plurality of gears 107 and 108 to synchronize with precision the movement of the second component 21 (via the gears 41A) with the eccentric cam 91 (via the gears 106).

The ring with the plurality of extensions 69 with rounded profiles or reliefs 69A interact with the variable profiles or reliefs 65A of the ring 65. Said ring that interacts with the variable profiles or reliefs 65A of the ring 65, said ring with the plurality of rods 69 is joined fixedly to the rods 98 through the orifices 69B. The rods 98 are used to rigidly affix the ring with extensions or rounded reliefs 69 and the motor 100 and 101. The electric motor 100 whose gear 102 interacts with the straight teeth 65B of the ring 65. Said ring 65 is a modified piece of the earlier design, but modified such that the lateral pins have been removed and a plurality of gear teeth 65B on the outside of the piece. The thrust bearing 57 is locked within the edges 59 and the guide 43 and the edge 61 of the sliding block 49 that restricts the longitudinal movement of the fourth component 25 in relation to the third component 23 and allows the rotation of said thrust bearing 57 in relation to the fourth component 25, that is to say, it allows the rotation of the fourth component 25 in relation to the third component 23. Thus turning the endless screw 102 of the electric motor 100 and interacting with the straight gear teeth 65B of the ring 65 which will turn said ring 65 around the axis and moreover it will turn the union of said ring 65 formed by the ring 71 and the thrust bearing 57. Turning said ring 65, the plurality of profiles or reliefs of varying height 65A will act on the plurality of rounded profiles or reliefs 69A of the ring with rounded extensions or reliefs 69 producing a longitudinal displacement of the ring 65 and the union of said ring 65 formed by: the ring 71 and the thrust bearing 57 which produces a longitudinal displacement of the third component 23 in relation to the first component 19. This longitudinal displacement of the third component 23 produced by the fourth component 25 will cause the first component 19 to rotate lightly in relation to the second component 21 around the longitudinal axis of the camshaft 15 thanks to the interaction between the first and third transmission mechanisms 29, 33 and the interaction between the ring 41 and the guides 43, as shown in the drawings. The design of the fourth component 25 is simple now that the pieces of which it is composed (the two rings, the thrust bearing, and others) are not complex, on the contrary, they are very simple now that they don't have intricate internal slots to function or complex links with other pieces, making them easy to manufacture and moreover it makes the fourth component 25 to not have excessive production costs, on the other hand, it doesn't require high precision mechanics or intricate forms to ensure long-lasting, quality functioning.

Other improvements introduced in the fourth component is the ring with rounded extensions or reliefs 69 that is joined fixedly to the plurality of rods 98 and in turn contains the fourth component 25 (jointly formed by the rings 65, 67, 71, and the thrust bearing 57), its function is to act with the ring with profiles and reliefs of varying heights 65 and to diminish the vibration of the device.

All the improvements in the device serve the purpose of improving reliability and function. One of the additional advantages of the fourth component 25 is varying the height of the profiles 65A of the ring 65 and therefore modify the device to the particular demand of each motor in a wide range of rpm.

Therefore the device can advance or retard the valve timing when the fourth component 25 produce a longitudinal movement in the third component 23, it causes a rotation of the first component 19 in relation to the second component 21 in the longitudinal axis 17 of the camshaft 15 via the coaction between the first and third transmission mechanism 29, 33 and via the coaction between the ring 41 and rods 43, as shown in the drawings.

The camshaft variator device is a mechanical device able to rearrange the camshaft of an internal combustion engine to allow high horsepower and high torque at high revolution per minute (rpm), and high power, high torque, less fuel consumption and smooth idle speed at low rpm. The purpose of the device is improving the power in a wide range of rpm. The camshaft variator device includes: a first component 19 for being connected or joined to the camshaft 15, a second component 21 joined to the crankshaft 13 via a timing belt or chain, and a third component 23 for joining the first and second component 19, 21 in a manner which allow the first component 19 and the second component 21 to move with different velocities, which produce a rotational movement in the first component 19 when a longitudinal force is applied to the third component, which is capable of rearranging the position of the camshaft 15 in relation to the crankshaft 13 while the engine is working. One of the main purposes of rearranging the camshaft is to change the angle between the intake and exhaust cam, because the angle plays an important role in the amount of fuel-air mixture that enters the piston cylinder. Depending on whether the cam opens the intake valve earlier or later, it allows a greater or smaller quantity of fuel-air mixture to enter. For example, an engine with an angle between the intake or admission cams and exhaust cams of 114° typically has high power and high torque at low rpm, and good idle speed. On the other hand, an engine with an angle between the intake cam and exhaust cam of 108° has high power and high torque at high rpm. When the intake cam opens the intake valve earlier, the exhaust valve does not close completely, and the exhaust gases escape through the exhaust valve, creating a vacuum. This vacuum boost the intake gases (fuel-air mixture) and allows bigger quantities of intake gases to enter the piston cylinder. That is exactly what is needed at high rpm, because it is required to fill the piston cylinder with fuel-air mixture as much as possible to get more efficient combustion process. When the intake cam opens the intake valve earlier at low rpm, part of the intake gases escape through the exhaust valve because it not closed completely and the fitting of the piston cylinder is poor. The result is bad idle speed, high fuel consumption, low horsepower and low torque at lower rpm. While the engine is working in both high and low rpm, the present invention makes the intake camshaft rotate, changing the angle between the intake and exhaust cams so that it is possible to get better filling of the piston cylinder when the present invention causes the intake valve to open earlier, closing the angle between the intake and exhaust cams at high rpm. The present invention is preferably set to low rpm, which means that the angle between the intake and exhaust cam are at typical "factory" setting at low rpm, with a relatively wide angle between the intake and exhaust cam, causing the intake valve to open later. The present invention allows the angle between the intake or admission cams and the exhaust cams to be changed by merely applying longitudinal force to improve power and torque at high and low rpm, thus providing high horsepower and torque, with low fuel consumption and less wear.

The new design of the fourth component 25 varies the angle of the camshaft and also allows an additional function in order to change the time that the valve is opened. Thanks to a second electric motor 101 that interacts with the gear teeth 67B rotating the ring 67 to produce a longitudinal movement of the ring 73 due to the interaction of the variable height profiles and reliefs 73B. When the ring 73 moves in horizontal sense to interact in the semicircular zone 73A, the eccentric cam 91 rotates to produce an alternative longitudinal movement on the ring 67 and this one moves the ring 65 thanks to the interaction of the variable height profiles and reliefs 73B and 67A respectively. The third component 23 is going to move in alternative longitudinal move because it is joined with the fourth component 25.

The alternative longitudinal movement of the ring 73 is produced by the eccentric cam 91 in the precise moment when the valve is still opened to vary the time, therefore the valve stays opened for a longer time. The movement is achieved because the eccentric cam 91 is synchronized with the second component 21 and at the same time with the crankshaft 13 therefore the eccentric cam 91 rotates when the second component 21 rotates. The alternative longitudinal movement is transmitted via the coaction of the gear teeth 106 that belongs to the eccentric cam 91 and the gear teeth 107, 108 respectively. The gear teeth 107, 108 rotates the gear teeth 41A of the second component 21, and the crankshaft 13 through the drive chain or drive belt rotate the second component 21.

The fourth component produces the alternative longitudinal movement when the camshaft 15 is going to close the admission valve to produce a retard of the camshaft 15 in relation to the crankshaft 13. It makes the admission valve stays opened longer time. The result is a bigger amount of air-fuel mixture to the cylinder.

Once the valve is already closed the eccentric cam 91 doesn't work and the movement finishes and the fourth component 25 and the third component 23 return to their original positions, therefore the camshaft 15 moves back to the original position. The fourth component 25 is simple and at the same time allows two functions in the motor engine:

to change the camshaft angle and to allow the valve to stay open a longer time.

The design of the device allows the use of cheap and light materials like plastic, instead of carbon steel.

None of the systems that exist in the market today have the capacity to vary duration of the opening and closing of valves.

Figure 1:
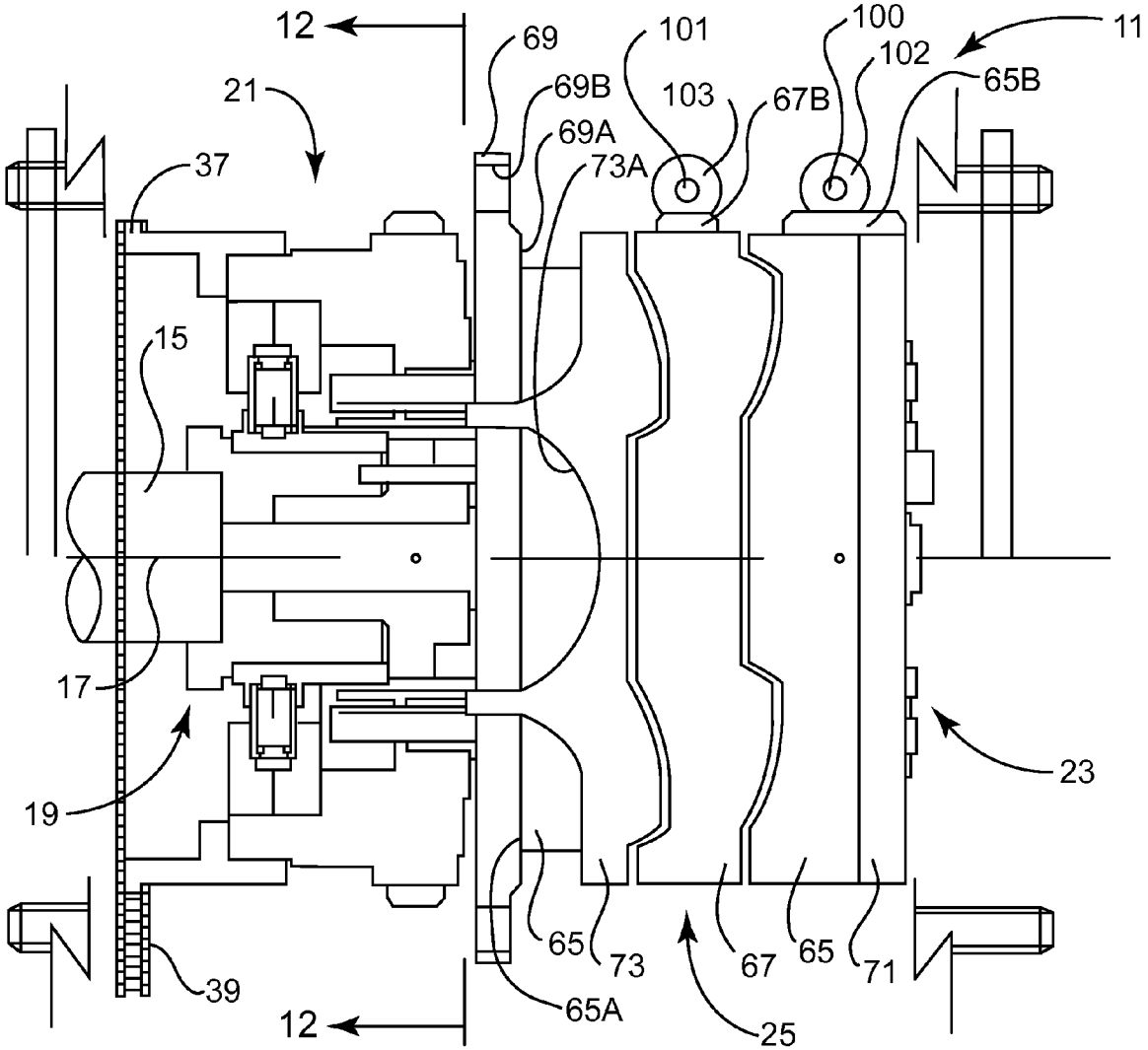
FIG. 1 is a side view of the camshaft variator device, showing a longitudinal cut.
Figure 2:
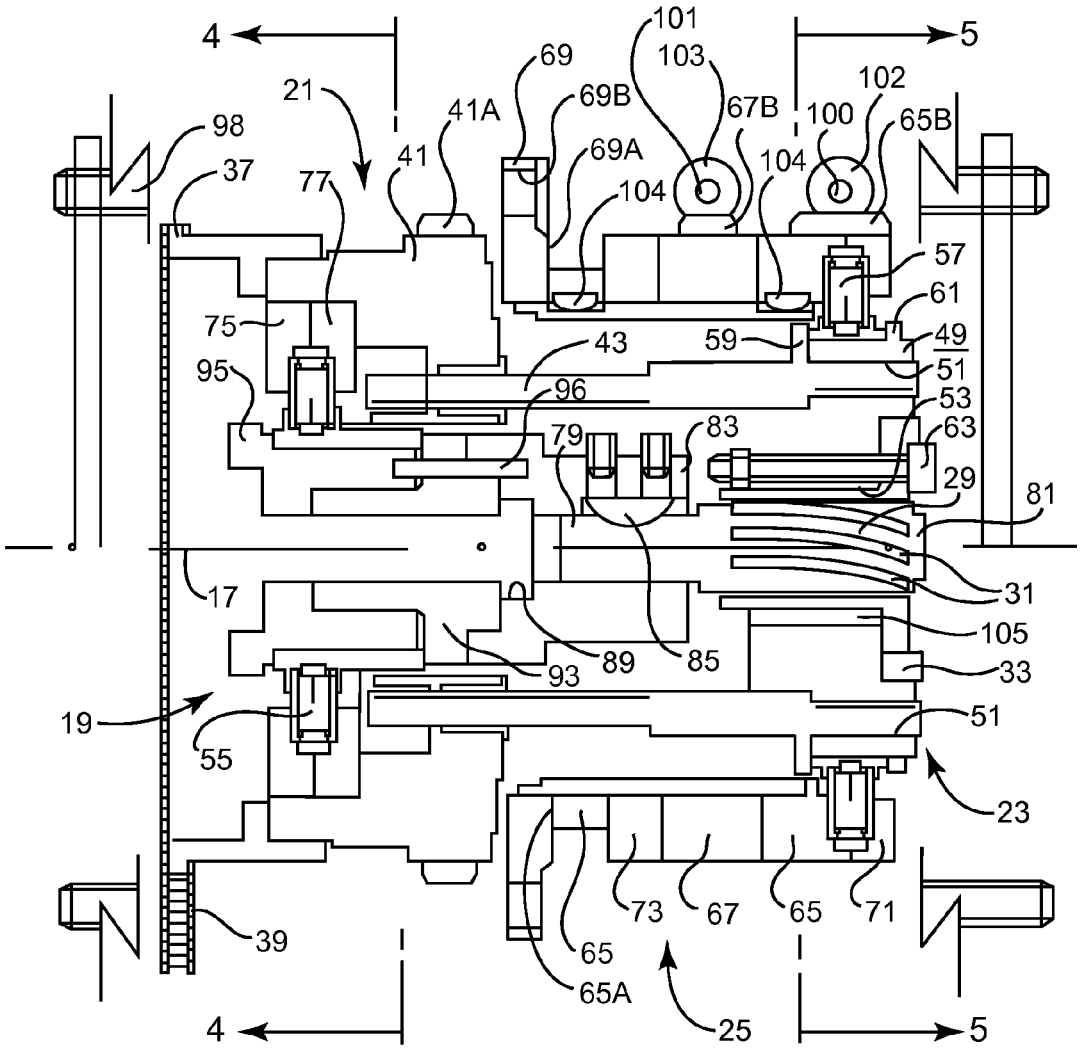
FIG. 2 is a longitudinal cut of the camshaft variator device.
Figure 3:
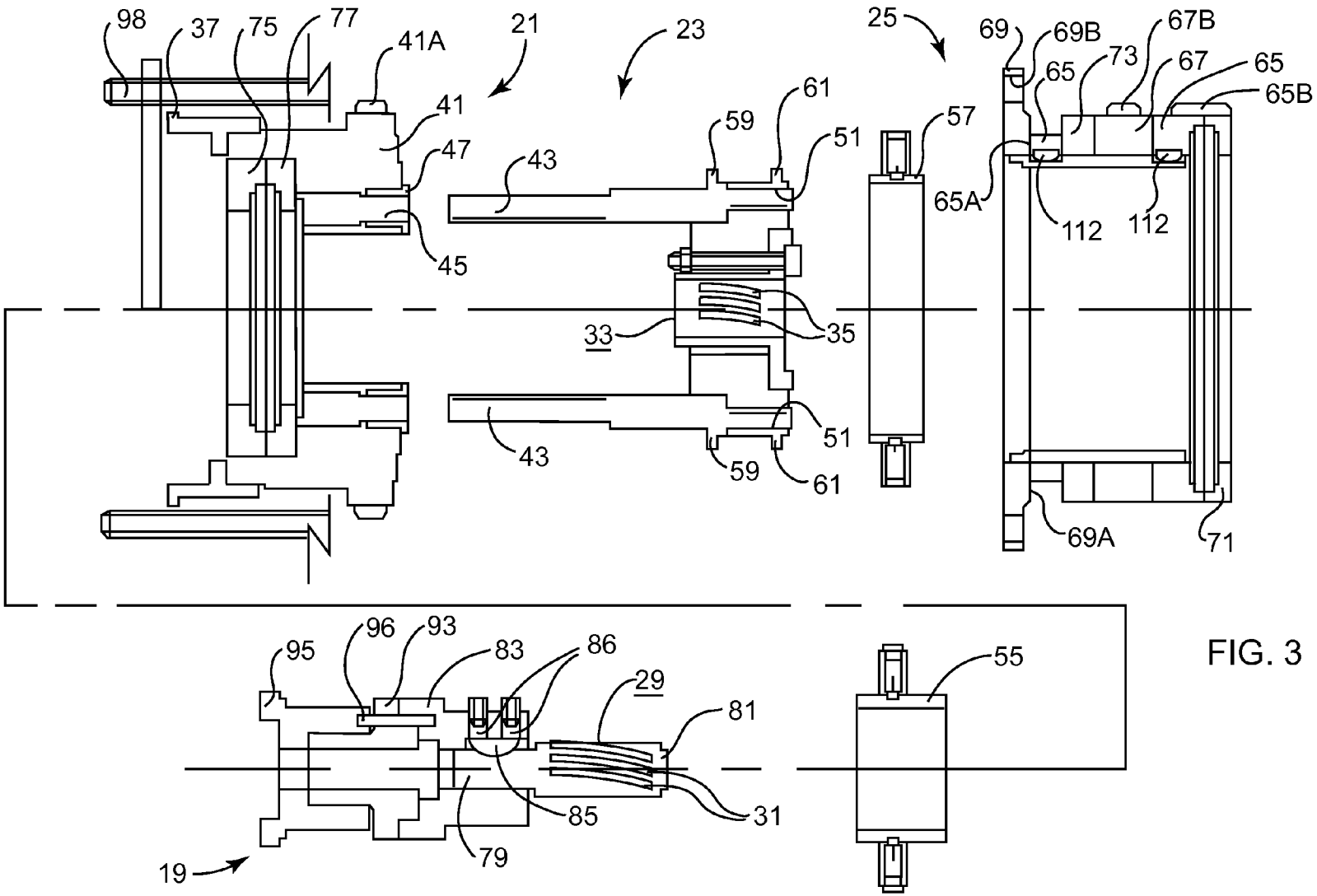
FIG. 3 is a longitudinal section of the disassembled variator camshaft device.
Figure 4:
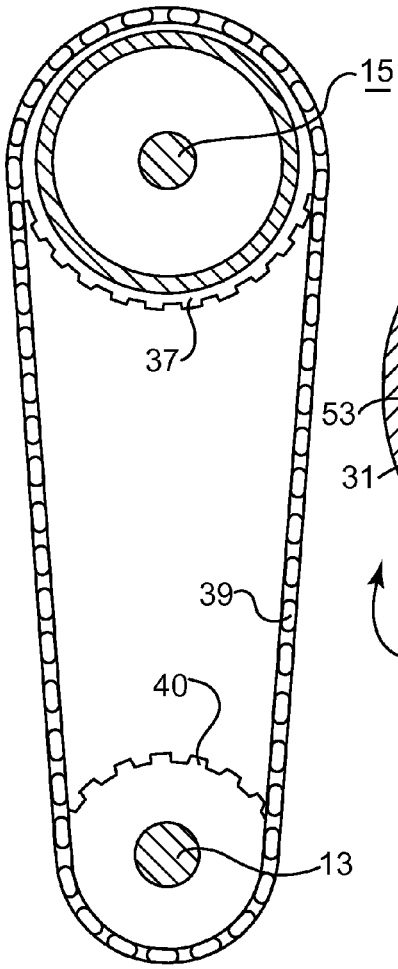
FIG. 4 is a view taken along the line 4-4 shown in FIG. 2.
Figure 5:
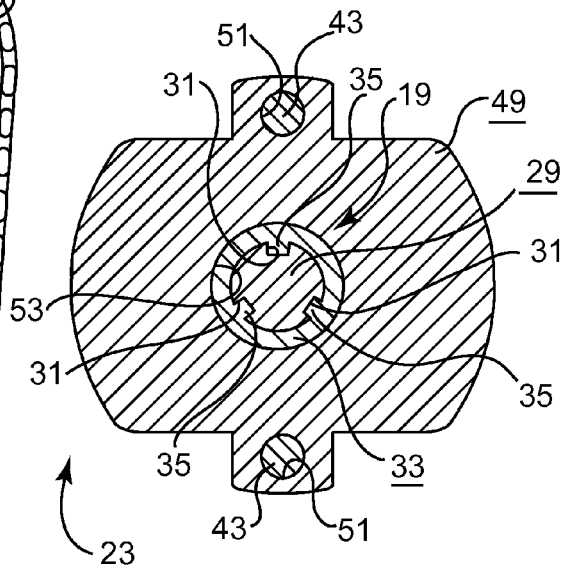
FIG. 5 is a view taken along the line 5-5 shown in FIG. 2.
Figure 6:
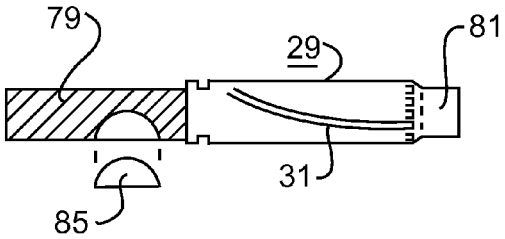
FIG. 6 is a view of the longitudinal section of the transmission mechanism of the first component.
Figure 7:
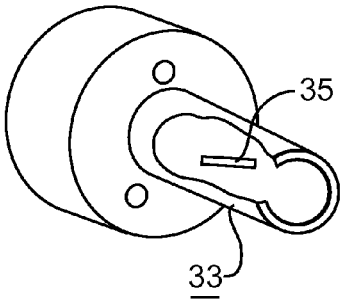
FIG. 7 is a perspective view of the transmission mechanism.
Figure 8:
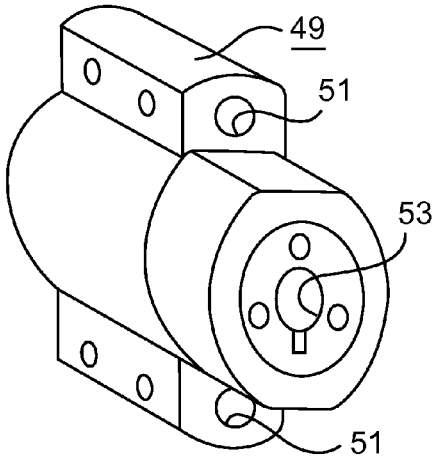
FIG. 8 is a perspective view of the sliding brick of the third component.
Figures 9, 9A:
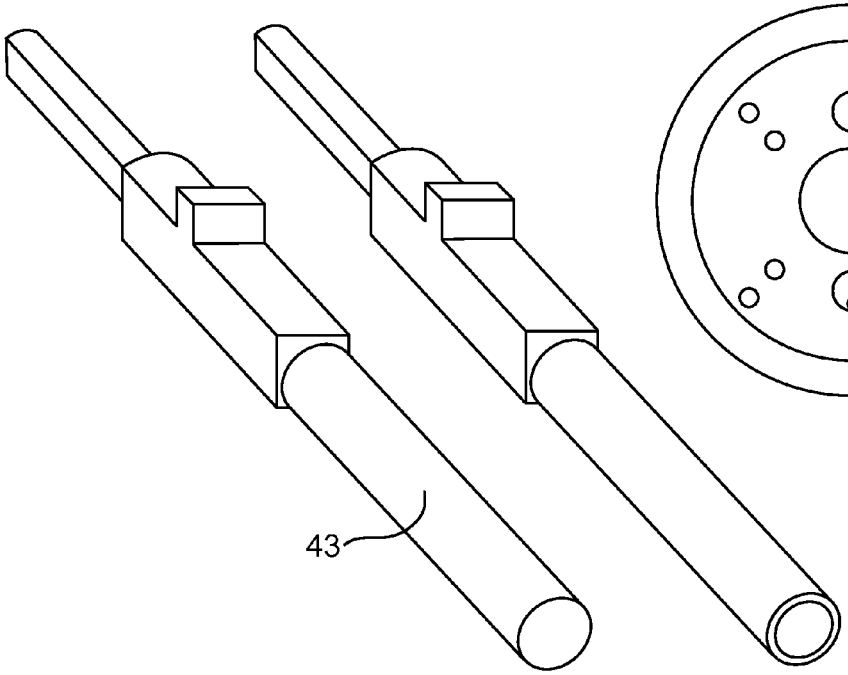
FIG. 9 is a perspective view of the rods of the third component.
Figure 10:
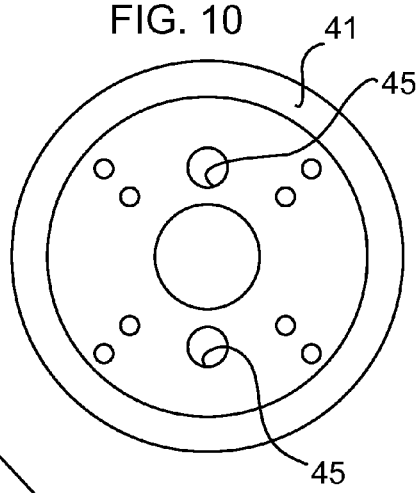
FIG. 10 is a frontal view of the ring of the second component.
Figure 11:
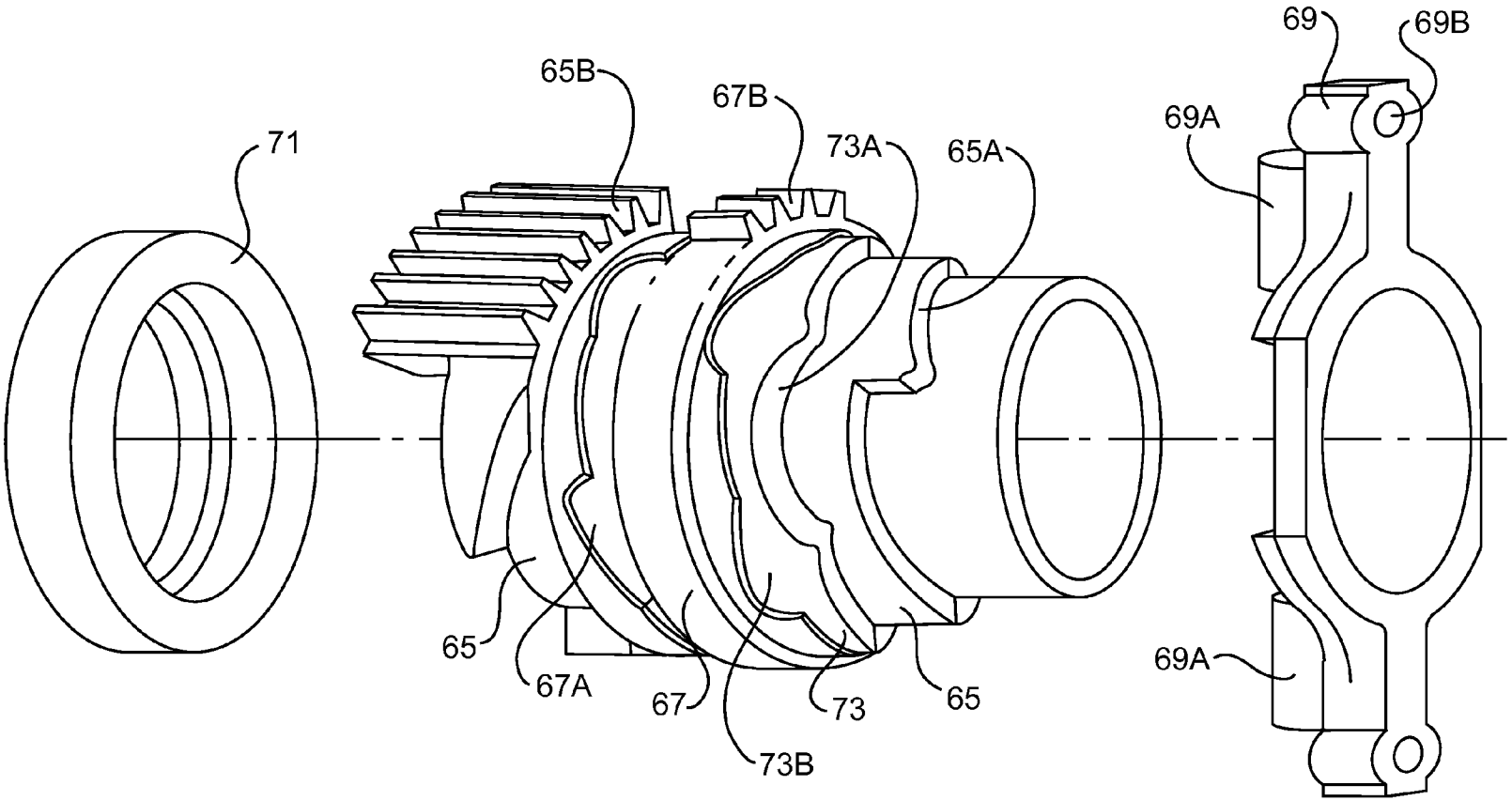
FIG. 11 is a perspective view of the fourth component.
Figure 12:
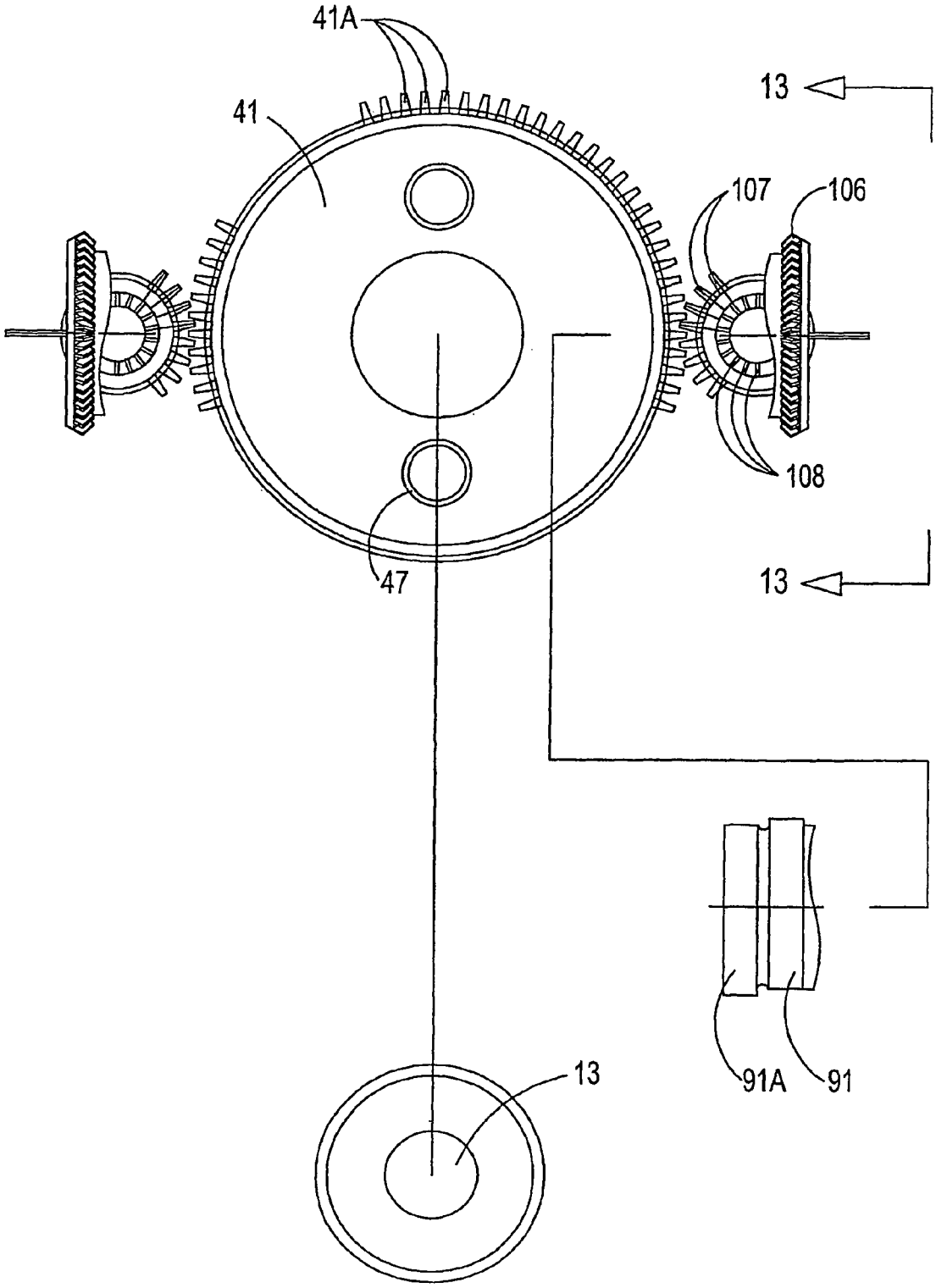
FIG. 12 is a view taken along the line 12-12 shown in FIG. 1.
Figure 13:
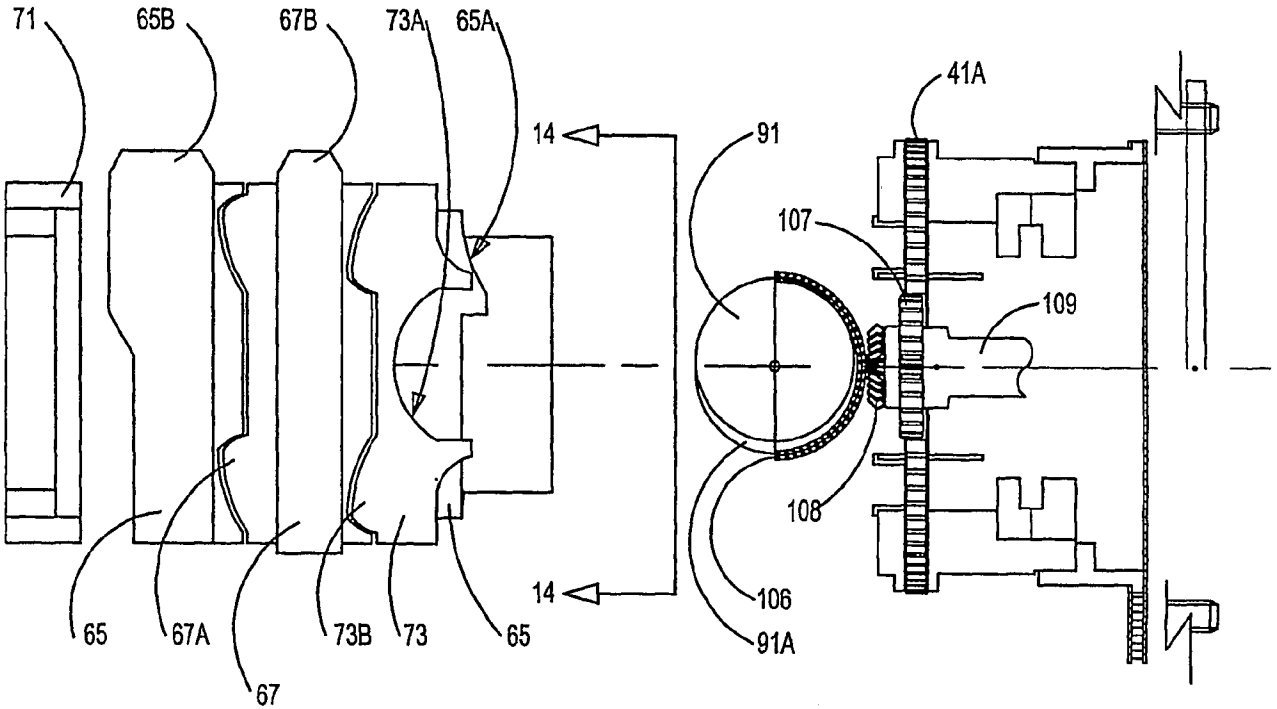
FIG. 13 is a view taken along the line 13-13 shown in FIG. 12.
Figure 14:
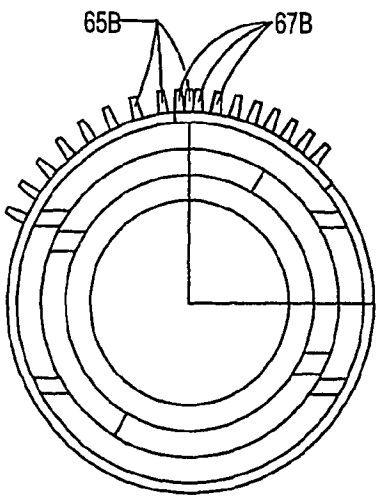
FIG. 14 is a view taken along the line 14-14 shown in FIG. 13.

The invention claimed is:

1. A camshaft variator device for an internal combustion engine including a crankshaft and a camshaft; said camshaft variator device comprising:

a) a first component for fixed attachment to said camshaft so that rotation of said first component will cause said camshaft to rotate; said first component including a transmission mechanism of the first component having at least one spiral tooth;

b) A second component for being rotated by said crankshaft;

c) A third component to join said first and second components to one another so that said first component will rotate when said second component is rotated by said crankshaft and for rotating said first component relative to said second component to rearrange the positional relationship of said camshaft relative to said crankshaft; said third component including a transmission mechanism of the third component having at least one spiral tooth for coacting with said spiral tooth of said transmission mechanism of the first component so that longitudinal movement of said transmission mechanism of the third component relative to said transmission mechanism of the first component will cause rotation of said transmission mechanism of the first component; said third component including a plurality of spaced apart male members; and d) a fourth component, interposed between said second component and said third component, for causing longitudinal movement of said third component;

said second component having a plurality of spaced apart female members for slidably receiving said male members of said third component to secure said second and third component together in a manner which allows longitudinal movement of said third component relative to said second component while preventing rotation of said third component relative to said second component.

2. The camshaft variator device as recited in claim 1, in which said fourth component includes motive power component for applying a longitudinal force to said third component.

3. The camshaft variator device of claim 1 in which said fourth component includes a first container ring and a second container ring, said first container ring having on one side thereof a plurality of first variable height profiles in its length and having on the other side thereof a plurality of cavities in which are located a plurality of variable height profiles along its length; said second container ring including gear teeth on an outer side and having, on a rear side thereof, a change section to fit a thrust bearing.

4. The camshaft variator device as recited in claim 3 in which said fourth component includes a motive power produced by two electric motors, said first connection ring having gear teeth thereon, and said first electric motor rotates the first connection ring via coaction between a perpetual screw and said gear teeth of said first connection ring, and the second electric motor rotates said second connection ring via coaction between the perpetual screw and said gear teeth of said second connection ring.

5. The camshaft variator device as recited in claim 4 in which said fourth component further includes external rods on which said first and second electrical motors are located, said fourth component moving in alternative way via coaction of a plurality of eccentrics with said gear teeth, said electric motors producing motive power via coaction of the rings with round profiles in the end of each said rod, the plurality of gear teeth between the second and fourth component and the eccentrics.

6. The camshaft variator device of claim 1 in which said fourth component includes a first container ring and a second container ring, said first container ring having on one side thereof a plurality of first variable height profiles in its length and having on the other side thereof a plurality of cavities in which are located at least four variable height profiles along its length; said second container ring including gear teeth on an outer side.

7. The camshaft variator device of claim 1 in which said fourth component includes a first container ring and a second container ring; said first container ring having a first side with a semi-circular cavity therein for receiving an eccentric, and in having an opposite side that includes a plurality of variable height profiles along its length to coact with said second container ring.

8. The camshaft variator device as recited in claim 1 in which said fourth component includes a first container ring and a second container ring; said first container ring having a side including a change section to fit a thrust bearing; said thrust bearing being located between the change section and said second container ring.

9. The camshaft variator device of claim 1 in which the longitudinal movement of said fourth component is restricted in relation to the third component by a pair of edge located in the third component that allows the longitudinal movement of the third and fourth component together and, at the same time, allows the rotation of said fourth components in relation to said third component by a thrust bearing between the third and fourth component.

10. A camshaft variator device for an internal combustion engine including a crankshaft and a camshaft; said camshaft variator device comprising:

a) a first component for fixed attachment to said camshaft so that rotation of said first component will cause said camshaft to rotate; said first component including a transmission mechanism of the first component having at least one spiral tooth;

b) A second component for being rotated by said crankshaft;

c) A third component to join said first and second components to one another so that said first component will rotate when said second component is rotated by said crankshaft and for rotating said first component relative to said second component to rearrange the positional relationship of said camshaft relative to said crankshaft; said third component including a transmission mechanism of the third component having at least one spiral tooth for coacting with said spiral tooth of said transmission mechanism of the first component so that longitudinal movement of said transmission mechanism of the third component relative to said transmission mechanism of the first component will cause rotation of said transmission mechanism of the first component; said third component including a plurality of spaced apart male members, and d) A fourth component for causing longitudinal movement of said third component, in which longitudinal movement of said third component relative to said first component causes rotation of said first component relative to said second component;

said second component having a plurality of spaced apart female members for slidably receiving said male members of said third component to secure said second and third component together in a manner which allows longitudinal movement of said third component relative to said second component while preventing rotation of said third component relative to said second component, and said fourth component including a ring with a plurality of rods in an edge of said ring, said rods being spaced 180° one to each other; and each said rod including a round profile having a hole located in the end of each said rod.

11. A camshaft variator device for an internal combustion engine including a crankshaft and a camshaft; said camshaft variator device comprising:

a) A first component for fixed attachment to said camshaft so that rotation of said first component will cause said camshaft to rotate; said first component including a transmission mechanism of the first component having at least one spiral tooth;

b) A second component for being rotated by said crankshaft; and c) A third component to join said first and second components to one another so that said first component will rotate when said second component is rotated by said crankshaft and for rotating said first component relative to said second component to rearrange the positional relationship of said camshaft relative to said crankshaft; said third component including a transmission mechanism of the third component having at least one spiral tooth for coacting with said spiral tooth of said transmission mechanism of the first component so that longitudinal movement of said transmission mechanism of the third component relative to said transmission mechanism of the first component will cause rotation of said transmission mechanism of the first component; and d) a fourth component for causing longitudinal movement of said third component;

said third component including a plurality of spaced apart male members, and said second component having a plurality of spaced apart female members for slidably receiving said male members of said third component to secure said second and third component together in a manner which allows longitudinal movement of said third component relative to said second component while preventing rotation of said third component relative to said second component; said second component having an edge in which is included a plurality of gear teeth to produce alternative movement to said fourth component via the coaction of said gear teeth between said second component and said fourth component.

12. The camshaft variator device as recited in claim 11, in which said fourth component moves in alternative way via the coaction of a plurality of eccentrics with said plurality of gear teeth synchronized between said second component and said fourth component.

13. A camshaft variator device for an internal combustion engine including a crankshaft and a camshaft; said camshaft variator device comprising:

a) A first component for fixed attachment to said camshaft so that rotation of said first component will cause said camshaft to rotate; said first component including a transmission mechanism of the first component having at least one spiral tooth;

b) A second component for being rotated by said crankshaft; and c) A third component to join said first and second components to one another so that said first component will rotate when said second component is rotated by said crankshaft and for rotating said first component relative to said second component to rearrange the positional relationship of said camshaft relative to said crankshaft; said third component including a transmission mechanism of the third component having at least one spiral tooth for coacting with said spiral tooth of said transmission mechanism of the first component so that longitudinal movement of said transmission mechanism of the third component relative to said transmission mechanism of the first component will cause rotation of said transmission mechanism of the first component;

said third component including a plurality of spaced apart male members, and said second component having a plurality of spaced apart female members for slidably receiving said male members of said third component to secure said second and third component together in a manner which allows longitudinal movement of said third component relative to said second component while preventing rotation of said third component relative to said second component;

said first component being a shaft, and said first component including a change section to locate the screw head of the camshaft to join the first component to the camshaft, said camshaft variator device further includes a pin preventing rotation of the first component with respect to the camshaft.

* * * * *